US005333989A

United States Patent [19]

Missana et al.

[11] Patent Number: 5,333,989

[45] Date of Patent: Aug. 2, 1994

[54] ELECTRIC ACTUATORS FOR STEAM TURBINE VALVES

[75] Inventors: Adrian Missana, Scotia, N.Y.; Russell A. Gary, Marblehead, Mass.

[73] Assignee: General Electric Company, Schenectady, N.Y.

[21] Appl. No.: 995,365

[22] Filed: Dec. 23, 1992

[51] Int. Cl.[5] ..... F01D 17/00

[52] U.S. Cl. ..... 415/17; 415/29; 415/42; 415/150; 415/151; 251/129.04; 251/129.11

[58] Field of Search ..... 415/17, 29, 36, 42, 415/150, 151; 251/58, 129.04, 129.11, 129.12, 129.13

[56] References Cited

U.S. PATENT DOCUMENTS

| | | | |
|---|---|---|---|
| 368,674 | 8/1887 | Kent et al. . | |
| 528,483 | 10/1894 | Nixon . | |
| 2,195,219 | 3/1940 | McGoldrick | 251/129.12 |
| 2,803,197 | 8/1957 | Wiley et al. | 251/129.11 |
| 3,026,889 | 3/1962 | Bryant | 415/29 |
| 3,780,527 | 12/1973 | Lewis . | |
| 3,952,995 | 4/1976 | Nagumo et al. | 251/58 |
| 3,970,280 | 7/1976 | Kunz | 251/58 |
| 5,074,325 | 12/1991 | Rumberger et al. . | |
| 5,179,977 | 1/1993 | Iwata et al. | 251/129.11 |
| 5,184,593 | 2/1993 | Kobayashi | 251/129.11 |

FOREIGN PATENT DOCUMENTS

| | | | |
|---|---|---|---|
| 2275714 | 1/1976 | France | 251/58 |
| 657934 | 5/1949 | United Kingdom . | |

*Primary Examiner*—Edward K. Look
*Assistant Examiner*—James A. Larson
*Attorney, Agent, or Firm*—Nixon & Vanderhye

[57] ABSTRACT

Linear electric actuators powered by DC brushless servomotors are individually controlled to position steam turbine valves by way of levers, pins and links to thus eliminate hydraulics and the attendant disadvantages of fluid filtering, conditioning and leakage as well as obtaining more flexible individual valve control, vis-a-vis, camshaft operated hydraulic actuators. Additionally, low friction actuators and springs are employed to automatically close the turbine valves in the event of a power failure.

7 Claims, 3 Drawing Sheets

ELECTRIC ACTUATORS FOR STEAM TURBINE VALVES

FIELD OF THE INVENTION

The invention relates to actuators for controlling steam turbine valves for admission of steam to the turbine nozzles.

BACKGROUND AND SUMMARY OF THE INVENTION

High pressure steam is introduced into steam turbine drives for dynamoelectric machines by way of controlling valves. Typically, a multitude of valves are mounted about such turbine drives. Such valves are equipped with actuators for positioning the valve so as to supply or extract steam at the pressures and quantities required under varying system conditions.

Modern control systems for turbine generators incorporate electronic speed and pressure sensors, along with digital processing and logic for, among other things, position control of steam turbine valves, as generally illustrated in FIG. 1, for example. Such valves are conventionally hydraulically operated by way of hydraulic servo-actuators within servo-actuator module 1, as determined by control signals as demanded from the operator control panel and display unit 2. The hydraulic servo-actuators in turn control the position of the steam valves by way of mechanical linkages.

Such hydraulic units conventionally include a remotely located hydraulic power unit 3, as well as tubing runs between the power unit and the valve actuators. These systems are relatively expensive since they require the use of either a phosphate ester hydraulic fluid including a Fuller's earth treatment system or, alternatively, petroleum based fluid with guarded hydraulic lines. Thus, leakage, contamination and possible low temperature problems may occur.

Still other known manners of controlling steam turbine valves involve pneumatic cylinders or diaphragms for relatively small control valves. In some older mechanically controlled turbine generator systems, the use of steam cylinders for operating low pressure grid-type extraction valves have also been known. However, the use of steam actuation is clearly not compatible with the requirements of modern electronic control systems of the nature generally illustrated in FIG. 1. Moreover, the use of pneumatic systems has the disadvantage of requiring large cylinders based on the use of available low pressure air and the resulting lack of system stiffness.

Still other more contemporary hydraulic systems involve a completely self-contained hydraulic system along with an actuator which are used for application to individual valves. It has been found, however, that such self-contained hydraulic systems for each of several valves in the contemplated environment would be applicable only to very large turbine units with off-shell steam chests. Moreover, such systems are relatively costly and require a significant increase in space with respect to other forms of actuators.

We have discovered that each of the steam turbine admission or extraction valves may have its own ball-screw linear electric actuator for operatively driving the valve open or closed by way of a lever, pins and links. Moreover, the actuator screw may be precisely driven by a DC brushless servomotor for accurately positioning the turbine valve at selected set points. Still further, since the ball-screw actuator arrangement is of a low-friction type, the actuators are fully capable of being driven to a closed position by way of an external force, such as that provided by a spring in the event of a power failure.

Accordingly, the objects of the herein disclosed exemplary embodiment include that of eliminating all hydraulics from the turbine control system including the conventional remotely located hydraulic power unit. Still further, all hydraulic tubing and fittings as well as mechanisms such as pinions, racks, cams and camshafts for these valves are eliminated. Thus, a more simple and less costly system is obtained whereby the use of hydraulic fluid and its attendant filtering, conditioning and leakage problems are absent. A still further object of the present system is that of employing a linear electric actuator for such steam valves which will require only electrical connections for handling position, feedback and power signals. In such a system the steam valves may be individually closed or opened in a relatively simple and flexible manner rather than being opened and closed in a fixed order, such as through the use of a camshaft.

BRIEF DESCRIPTION OF THE DRAWINGS

These as well as other objects and advantages will be better appreciated by a careful study of the following detailed description taken in conjunction with the accompanying drawings in which.

DETAILED DESCRIPTION OF THE DRAWINGS

Figure 1:
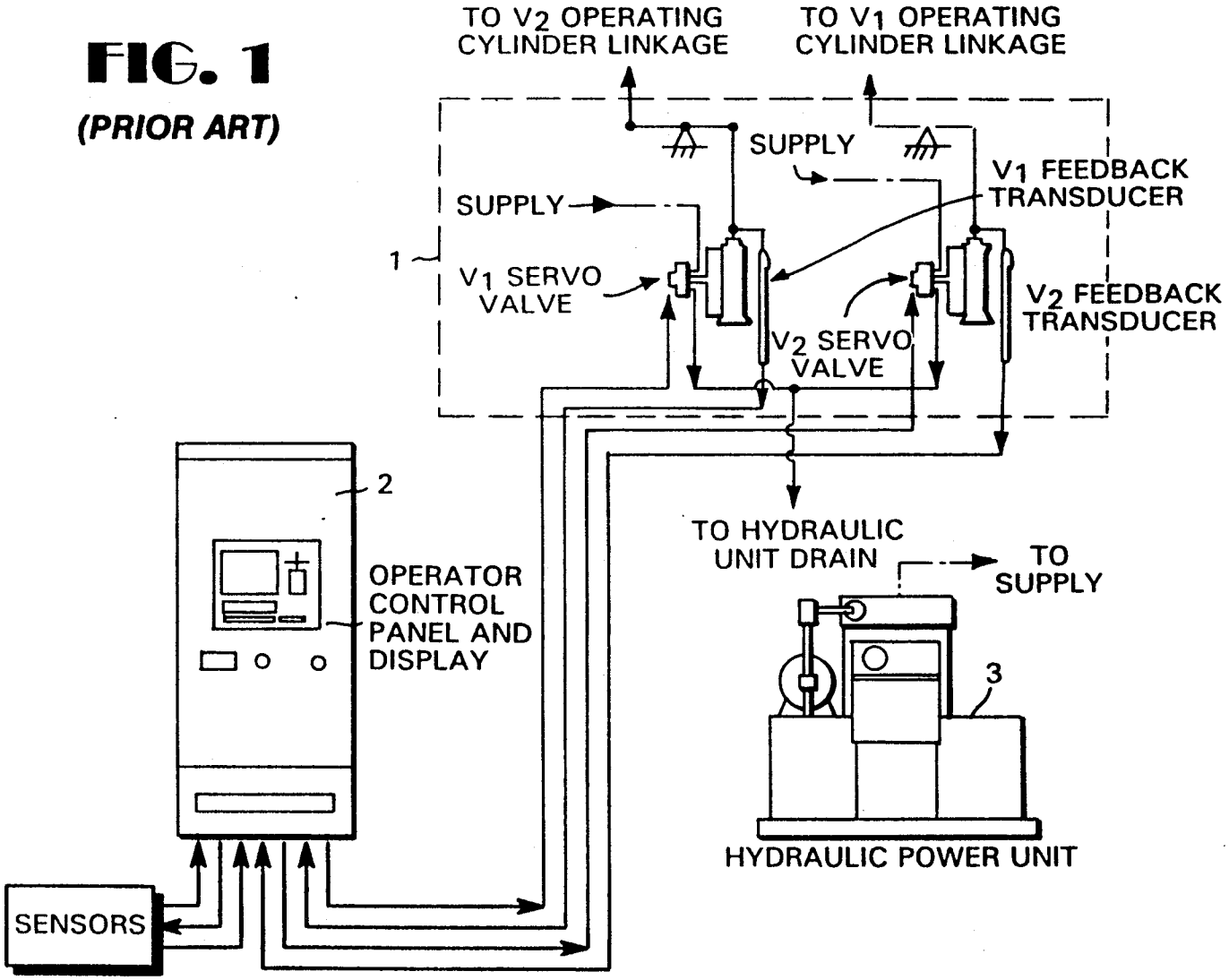
FIG. 1 (PRIOR ART)
FIG. 1 illustrates a conventional control system for a turbine drive unit wherein the steam valves are hydraulically operated.

As aforementioned, modern control systems used for turbine-generators use electronic sensors and digital logic for producing output control signals for operating electric hydraulically controlled valves whereby hydraulic power units (3) of FIG. 1 can supply fluid to hydraulic actuators which in turn position turbine steam valves. Turbines into which high pressure steam is piped typically include a multitude of valves mounted to admit steam to the turbine nozzles. Under such conditions, many hydraulic lines and fittings are necessary to supply fluid to and from the conventional actuators by the hydraulic power unit. The routing of such hydraulic tubing and fittings along with fluid treatment and leak protection in such systems is relatively complex and expensive.

Figure 3:
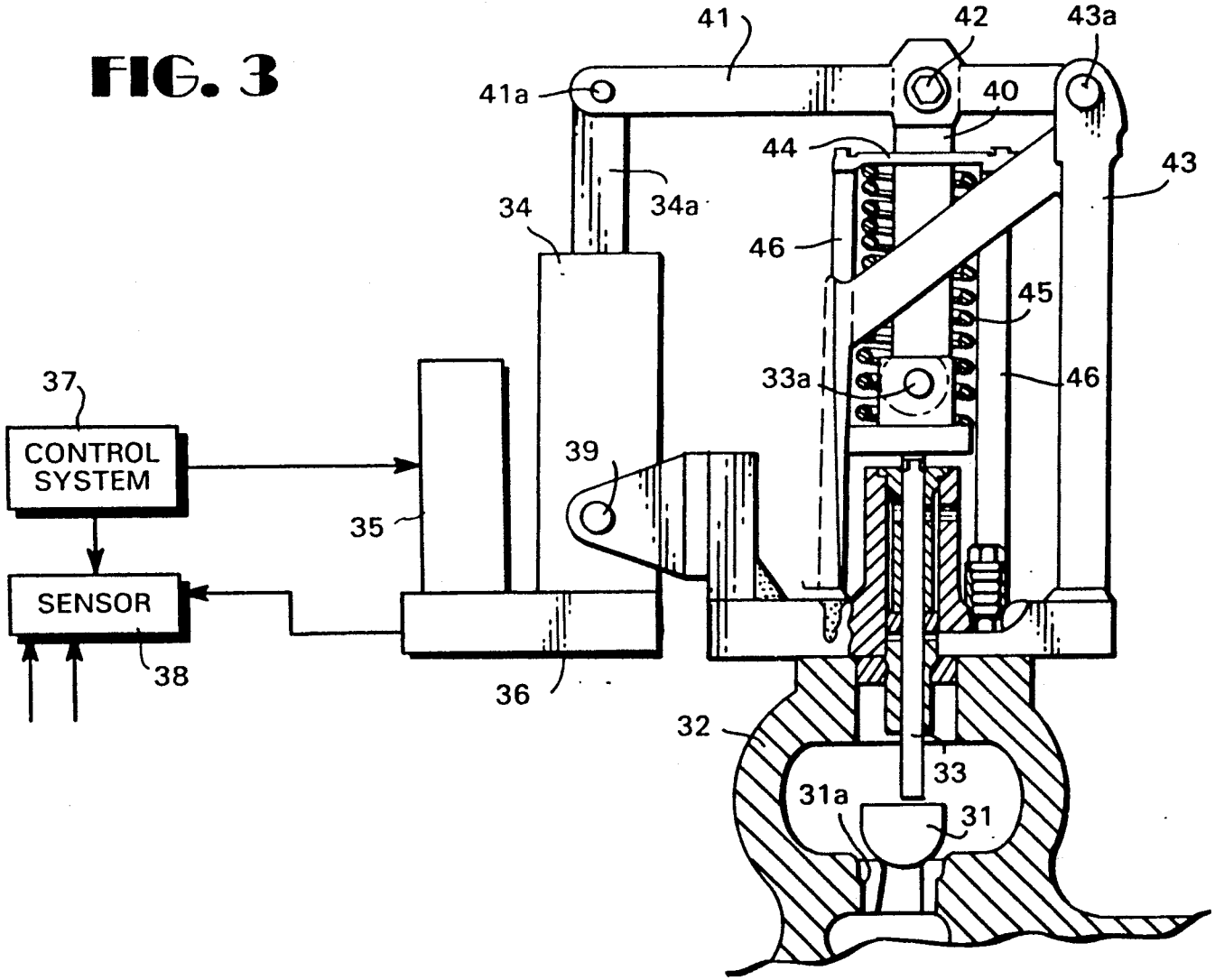
FIG. 3 is an exemplary embodiment of a steam turbine control valve which may be precisely positioned and controlled by way of the electrical actuator/mechanical linkage system of the present invention.

As may be seen from FIG. 3, a control valve 31 mounted as illustrated in a steam chest 32 may be controllably positioned with respect to valve seat 31*a* by movement of valve stem 33 to control the admission of steam to the unillustrated turbine nozzles. Although several such valves are typically used, only one is illustrated for the sake of clarity. Each such valve is equipped with a linear actuator 34 powered by a DC brushless servomotor 35 by way of drive mechanism 36. The drive mechanism may include directly connected gearing arrangements or may include toothed wheels along with a timing belt. As a further alternative, the servomotor shaft may be directly coupled to the actuator ball screw. In response to turbine speed, steam pressure and position sensors generally illustrated at 38, control system 37 may supply electrical drive signals to the individual actuator servomotors 35 for individually adjusting the position of a valve such as 31.

Figure 2:
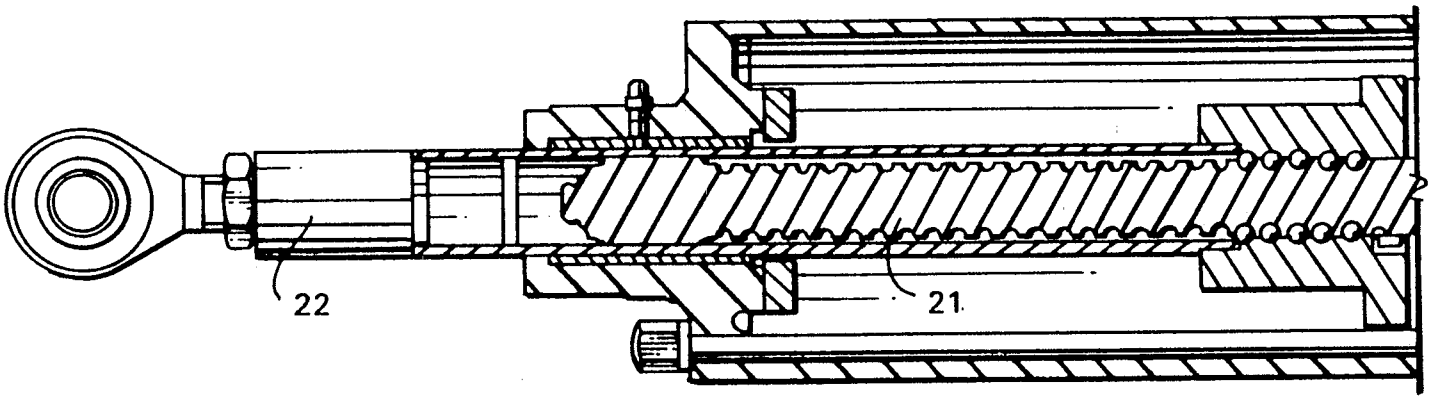
FIG. 2 (PRIOR ART)
FIG. 2 is an illustration of a conventional ball-screw linear electric actuator.

As may be seen in FIG. 2, each actuator 34 may include a conventional ball-screw 21 for converting rotary motion to linear motion for linearly adjusting the position of the actuator shaft 22. Such actuators are known in the prior art and are known to include parallel gear or right angle gear electrical motors as well as direct drive arrangements. Such actuators have been known to be applied to diverse applications, such as the positioning of parabolic antennas, actuating ladle preheaters in steel mills, and for positioning car assembly components for spray paint systems.

As applied in the presently disclosed exemplary embodiment illustrated in FIG. 3, the reciprocal linear motion of the actuator 34 which is pivotally mounted at 39 is conveyed by way of shaft 34*a* to the valve lift rod 40 by way of a force-multiplying lever 41. Lift rod 40 is pivotally connected to the lever at 42, and lever 41 is pivotally mounted to actuator shaft 34*a*, as well as being pivotally connected to support element 43 at 43*a*.

Lift rod 40 passes through spring support element 44 and is pivotally connected to the upper portion of valve stem 33 at 33*a*. As will be noted, spring 45 is compressed against fixed element 44, as the steam valve 31 is opened. Actuators of the low friction ball-screw type are selected, as is spring 45, so as to incorporate a fail-safe operation for closing the steam valves in the event of a power loss to the actuators. That is to say, the spring must be sufficiently strong as to be capable of overcoming valve stem unbalanced forces as well as actuator friction to drive the steam control valve 31 closed upon the loss of electrical power.

Additionally, the actuator must be sized so as to be sufficient to overcome the full steam pressure differential across valve 31 when it is in the closed position. However, since the force of the steam on valve 31 drops off substantially once the valve is lifted from its seat 31*a*, the overload capability of the actuator may be used for initiating the valve opening, thus somewhat reducing the required actuator size.

In operation the servomotor 35 of each actuator can be individually controlled by way of signals from control system 37. Shaft 34*a* of the actuator is longitudinally positioned in response to the servomotor output by way of drive unit 36 and the ball screw arrangement to convey linear motion to the valve 31 by way of the force-multiplying lever 41, as well as lift rod 40 and valve stem 33. Incorporation of pivotal joints at 33*a*, 39, 41*a* and 42 compensate for any minor horizontal movement of the axis at 42 due to the arcuate motion of lever 41. Thus, valve stem 33 will remain substantially vertical (as illustrated in the figure) without applying exceptional horizontal forces on valve stem, seals and the like.

As aforementioned, when valve 31 has been moved to an open position and the actuator suffers a loss of power, spring 45 has been compressed against support element 44 by the upper portion of valve stem 33. Since the springs are selected so as to be capable of overcoming any valve stem unbalanced forces present, as well as overcoming the relatively low friction of the actuator, the valve will be driven to the closed position by the spring forces so as to obtain a fail-safe operation.

As an alternative or modification to the relatively compact arrangement of FIG. 3, lever 41 can be omitted and actuator/motor elements 34, 35 may be mounted to directly drive lift rod 40. For example, vertical extensions of elements 46 can be included for supporting the actuator/motor in an inverted position so that shaft 34(*a*) is directly coupled to and coaxial with lift rod. Such an arrangement would maintain the relative simplicity noted above as well as the fail-safe feature. However, since the force multiplying lever is omitted, a stronger actuator is required.

Thus, as will be appreciated by the artisan, the disclosed exemplary embodiment eliminates hydraulics from the turbine control system including the need for extensive hydraulic tubing runs, the conventionally used remotely located hydraulic power unit, and the attendant fluid filtering, conditioning and leakage problems. In contrast, the present system employs linear electric actuators for each steam valve, requiring only electrical connections for position feedback signals and power. Incorporation of the disclosed features results in a simpler, less costly system wherein a fail-safe operation is incorporated, as well as allowing greater control flexibility of each of several steam valves which may be individually position controlled rather than being opened and closed in a fixed order as is conventionally obtained by way of a camshaft or the like.

While the invention has been described with respect to what is presently regarded as the most practical embodiment thereof, it will be understood by those of ordinary skill in the art that various alterations and modifications may be made which nevertheless remain within the scope of the invention as defined by the claims which follow.

What is claimed is:

1. A steam turbine control system comprising:

at least one valve for controlling the admission or extraction of steam to a turbine;

a lever;

a support element for pivotally supporting one end of said lever;

an electrically operated linear actuator for pivotally supporting another end of said lever, said actuator including a linearly extendable shaft, an electric motor and a drive means operatively connected between the motor and the shaft for reciprocally positioning said shaft at a controllable and selectable position;

sensor means for determining system operating conditions and for providing signals indicative of the conditions;

a control means responsive to said sensor means and connected to said actuator for supplying electrical signals and power to said motor for controllably positioning said valve at a said selectable position;

a linkage element pivotally connected between said lever and said valve for conveying linear motion to said valve; and said support element including means for pivotally mounting said actuator so that an axis along which the actuator shaft reciprocally extends cooperatively moves with an axis along which the linkage element reciprocally extends so as to compensate for any horizontal movement of the linkage element axis at the pivotal connection between said linkage element and said lever;

a spring supportably mounted about said linkage element and operatively connected to said valve for forcing said valve to a closed position in the absence of electrical power being supplied to said motor.

2. A steam turbine control system as in claim 1 wherein said valve includes a valve stem having a spring support element pivotally connected to said linkage element.

3. A steam turbine control system as in claim 2 wherein said spring comprises a coil spring, said linkage element is a lift rod extending in a direction along substantially the same axis as said coil spring and the lift rod is pivotally connected to the lever and the valve stem spring support element.

4. A steam turbine control system comprising:

at least one valve for controlling the admission or extraction of steam to a turbine;

a lever;

a support element for pivotally supporting one end of said lever;

an electrically operated linear actuator for pivotally supporting another end of said lever, said actuator including a linearly extendable shaft, an electric motor and a drive means operatively connected between the motor and the shaft for reciprocally positioning said shaft;

a control means connected to said actuator for selectively supplying electrical signals and power to said motor;

a linkage element pivotally connected between said lever and said valve for conveying linear motion to said valve; and a spring supportably mounted about said linkage element and operatively connected to said valve for forcing said valve to a closed position in the absence of electrical power being supplied to said motor, wherein said motor is a DC brushless servomotor.

5. A steam turbine control system comprising:

at least one valve for controlling the admission or extraction of steam to a turbine;

a lever;

a support element for pivotally supporting one end of said lever;

an electrically operated linear actuator for pivotally supporting another end of said lever, said actuator including a linearly extendable shaft, an electric motor and a drive means operatively connected between the motor and the shaft for reciprocally positioning said shaft;

a control means connected to said actuator for selectively supplying electrical signals and power to said motor;

a linkage element pivotally connected between said lever and said valve for conveying linear motion to said valve; and a spring supportably mounted about said linkage element and operatively connected to said valve for forcing said valve to a closed position in the absence of electrical power being supplied to said motor, wherein said drive means includes a toothed wheel and a timing belt.

6. A steam turbine control system comprising:

at least one valve for controlling the admission or extraction of steam to a turbine;

a lever;

a support element for pivotally supporting one end of said lever;

an electrically operated linear actuator for pivotally supporting another end of said lever, said actuator including a linearly extendable shaft, an electric motor and a drive means operatively connected between the motor and the shaft for reciprocally positioning said shaft;

a control means connected to said actuator for selectively supplying electrical signals and power to said motor, a linkage element pivotally connected between said lever and said valve for conveying linear motion to said valve; and a spring supportably mounted about said linkage element and operatively connected to said valve for forcing said valve to a closed position in the absence of electrical power being supplied to said motor, wherein said drive means is a gearing arrangement.

7. A steam turbine control system comprising:

at least one valve for controlling the admission or extraction of steam to a turbine;

a lever;

a support element for pivotally supporting one end of said lever;

an electrically operated linear actuator for pivotally supporting another end of said lever, said actuator including a linearly extendable shaft, an electric motor and a drive means operatively connected between the motor and the shaft for reciprocally positioning said shaft;

a control means connected to said actuator for selectively supplying electrical signals and power to said motor;

a linkage element pivotally connected between said lever and said valve for conveying linear motion to said valve; and a spring supportably mounted about said linkage element and operatively connected to said valve for forcing said valve to a closed position in the absence of electrical power being supplied to said motor, wherein said actuator includes a ball screw for providing linear motion to the actuator shaft.

* * * * *